United States Patent [19]

Menon et al.

[11] 4,082,444

[45] Apr. 4, 1978

[54] LAMP CARRIAGE DRIVE SYSTEM

[75] Inventors: Sukumaran K. Menon, Webster; Stephen J. Wenthe, Jr., Rochester, both of N.Y.

[73] Assignee: Xerox Corporation, Stamford, Conn.

[21] Appl. No.: 681,956

[22] Filed: Apr. 30, 1976

[51] Int. Cl.[2] ..... G03G 15/28

[52] U.S. Cl. ..... 355/8; 355/67; 355/84; 358/293

[58] Field of Search ..... 355/8, 11, 65, 66, 81, 355/84, 67; 358/285

[56] References Cited

U.S. PATENT DOCUMENTS

| | | | |
|---|---|---|---|
| 3,655,284 | 4/1972 | Agliata | 355/66 X |
| 3,950,091 | 4/1976 | Brooke | 355/84 X |
| 3,990,792 | 11/1976 | Kono et al. | 355/8 |

*Primary Examiner*—Richard L. Moses

*Attorney, Agent, or Firm*—J. J. Ralabate; C. A. Green; H. Fleischer

[57] ABSTRACT

An apparatus in which an article is illuminated by a light source moving thereacross. Vibration of the light source is minimized during the movement thereof.

6 Claims, 5 Drawing Figures

LAMP CARRIAGE DRIVE SYSTEM

BACKGROUND OF THE INVENTION

This invention relates generally to an electrophotographic printing machine, and more particularly concerns an apparatus for illuminating and scanning an original document being reproduced thereby.

In the process of electrophotographic printing, a photoconductive surface is uniformly charged and exposed to a light image of an original document. Exposure of the charged photoconductive surface records thereon an electrostatic latent image corresponding to the original document. The electrostatic latent image is then rendered visible by depositing toner particles which adhere electrostatically thereto. Subsequently, the toner powder image is transferred to a sheet of support material which may be paper or a plastic material, amongst others. The toner powder image is, then, permanently affixed to the sheet of support material to provide a copy of the original document.

Multi-color electrophotographic printing is substantially the same as the heretofore discussed process. However, rather than forming a total light image of the original document, successive colored filter light images are formed. Each light image is filtered to produce a single color light image which is a partial light image of the original document being reproduced. The foregoing single color light image exposes the charged photoconductive surface recording thereon a single color electrostatic latent image. The single color light image is developed with toner particles of a color complementary to the single color light image. Thereafter, the single color toner powder image is transferred to the sheet of support material. The foregoing process is repeated a plurality of cycles with differently colored light images and the respective complementarily colored toner particles. Each single color toner powder image is transferred to the sheet of support material in superimposed registration with the prior toner powder image to form a composite multilayered powder image. The multi-colored powder image is coalesced and permanently affixed to the sheet of support material.

In the exposure process, a lamp moves across the original document to illuminate successive incremental areas thereof. In this way, a flowing light image of the original document is projected onto the charged portion of the photoconductive surface. Any oscillation or movement of the lamp in a direction other than the desired direction results in distortions of the light image being projected onto the photoconductive surface. This, in turn, degrades the resultant copy formed thereby. Hereinbefore, cables and pulleys were employed in conjunction with a drive motor to move the scan lamps across the original document. One type of system previously employed is described in U.S. Pat. No. 3,062,094 issued to Mayo in 1962. However, the system described therein makes no effort to minimize the jitter of the lamps moving across the original document.

With the advent of multi-color electrophotographic printing, it has become highly desirable to reproduce original documents such that the resultant copy will be pictorial in quality. This requires the utilization of precise controls in the electrophotographic printing machine to reduce errors contributing to degradation of copy quality. One such error source is the jitter of the scan lamps as they traverse the original document being reproduced.

Accordingly, it is a primary object of the present invention to improve the optical system illuminating an original document in an electrophotographic printing machine.

SUMMARY OF THE INVENTION

Briefly stated, and in accordance with the present invention, there is provided an apparatus for illuminating an article.

Pursuant to the features of the present invention, the apparatus includes a light source and means for supporting the article in a light receiving relationship with light rays transmitted therefrom. Moving means move the light source across the article. Means are provided for minimizing the vibration of the light source during the movement thereof.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
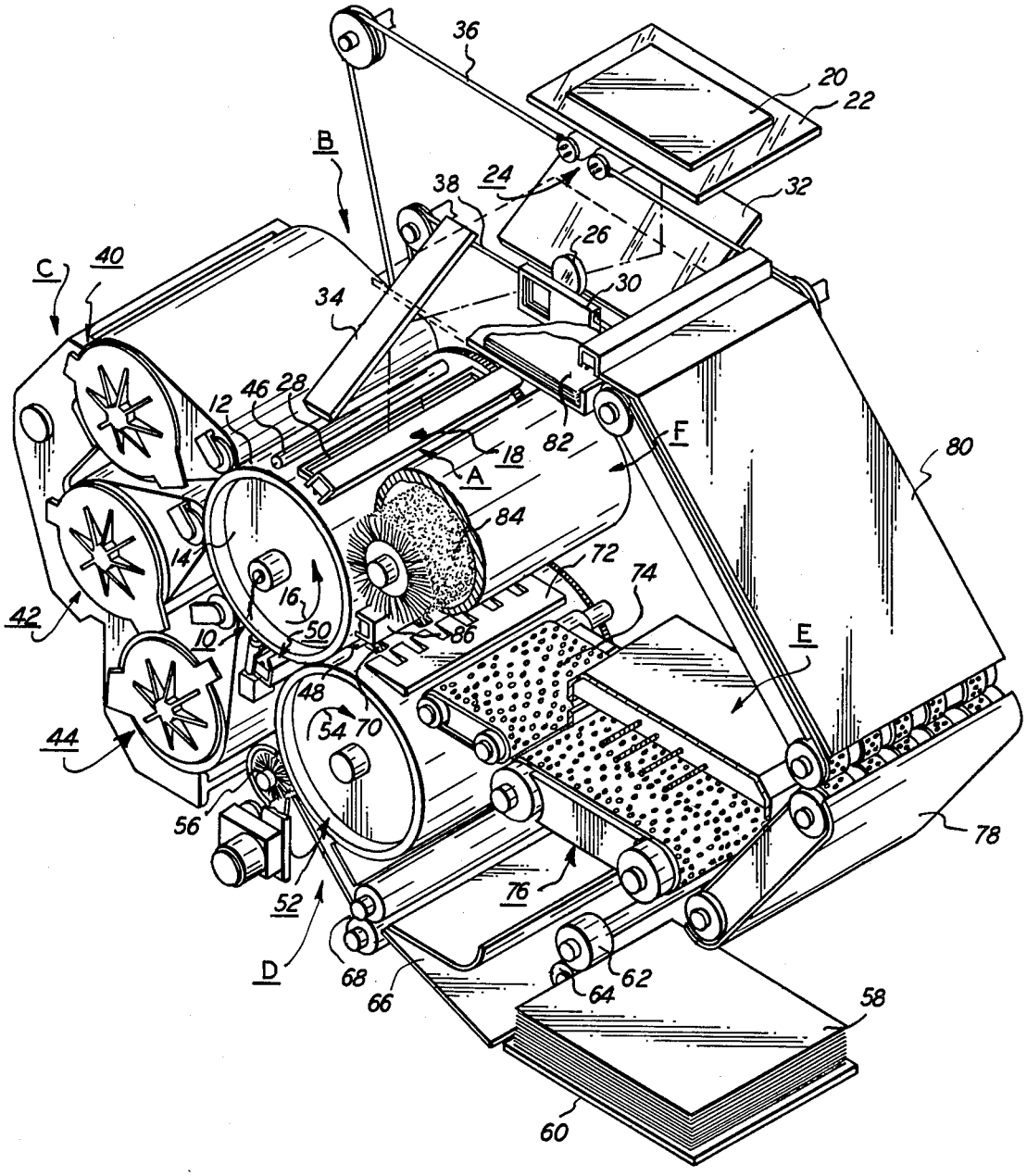
FIG. 1 is a schematic perspective view of an electrophotographic printing machine incorporating the features of the present invention therein.

For a general understanding of an electrophotographic printing machine in which the features of the present invention may be incorporated, reference is had to FIG. 1 which depicts schematically the various components thereof. In the drawings, like reference numerals have been employed throughout to designate identical elements. Although the apparatus of the present invention is shown as being employed in a color electrophotographic printing machine, it will be appreciated from the description herein that the present invention is not limited to color reproduction machines.

Inasmuch as the practice of electrophotographic printing is well known in the art, the various processing stations thereof will be only briefly described hereinafter with reference to FIG. 1.

As shown in FIG. 1, the electrophotographic printing machine includes a photoconductive member having a rotatable drum 10 including a photoconductive surface 12 entrained about and secured to a conductive substrate 14. Preferably, photoconductive surface 12 is made from a polychromatic selenium alloy of the type described in U.S. Pat. No. 3,655,377 issued to Sechak in 1972. A signal generator (not shown) rotates in conjunction with drum 10 to activate, at the appropriate time during the machine cycle, the various processing stations within the printing machine. As drum 10 rotates in the direction of arrow 16, photoconductive surface 12 is transported sequentially through a series of processing stations.

Initially, a substantially uniform electrostatic charge is formed on at least a portion of photoconductive surface 12 as it passes through charging station A. Charging station A has a corona generating device, indicated generally by the reference numeral 18, disposed thereat. Corona generating device 18 charges a portion of photoconductive surface 12 to a relatively high substantially uniform level. A suitable corona generating device is described in U.S. Pat. No. 3,875,407 issued to Hayne in 1975.

The charged portion of photoconductive surface 12 advances next to exposure station B. At exposure station B, the charged area of photoconductive surface 12 is exposed to a colored filter light image of original document 20. The image scanning system includes a lamp assembly 24 which illuminates document 20 disposed on transparent platen 22, a lens assembly 26, which focuses the document at an aperture in slit 28, and a color filter assembly 30. An image of original document 20 is reflected by object mirror 32 through lens assembly 26 and filter assembly 30. The color filtered light image is reflected by image mirror 34 through the aperture of slit 28 onto the charged portion of photoconductive surface 12. The imaging assembly is moved in a timed relationship with respect to the rotation of drum 10 permitting successive incremental areas of original document 20 to be projected thereon. This produces a non-distorted flowing light image of the original document on photoconductive surface 12. During exposure, filter assembly 30 interposes selected color filters into the optical light path. These color filters filter the light with is transmitted through lens assembly 26 to record an electrostatic latent image on photoconductive surface 12 corresponding to a specific color of the flowing light image of original document 20. Lamps 24 are driven by cable system 36. Similarly, lens 26 and filter 30 are driven by cable system 38. The detailed structural arrangement of exposure station B will be described hereinafter with reference to FIG. 2. In addition, the cable system thereof will be discussed in greater detail with reference to FIG. 3.

After passing through exposure station B, the latent image recorded on photoconductive surface 12 passes beneath lamp 46. This lamp is provided for exposing and discharging the inter-image spacing on photoconductive surface 12. Lamp 46 is energized for a predetermined interval of time in order to reduce the electrostatic latent charge in the inter-image area and thus prevent the development thereof at development station C.

Next, the electrostatic latent image recorded on photoconductive surface 12 rotates to development station C. At development station C, three individual developer units, generally indicated by the reference numerals 40, 42 and 44, respectively, are arranged to render visible the electrostatic latent image recorded on photoconductive surface 12. Preferably, each of the developer units is of a type generally referred to in the art as "magnetic brush developer units". A typical magnetic brush developer unit employs a developer mix which includes ferromagnetic carrier granules and heat settable toner particles triboelectrically attracted thereto. In operation, the developer mix is continually brought through a directional flux field forming a chian-like array of fibers frequently termed a brush. The electrostatic latent image recorded on photoconductive surface 12 is rotated into contact with the brush of developer mix. Toner particles are attracted from the carrier granules to the latent image. Each of the developer units contain appropriately colored toner particles. For example, a green filtered light image is developed by depositing magenta toner particles thereon. Similarly, a red filtered light image is developed with cyan toner particles and a blue filtered light image with yellow toner particles. A development system of this type is described in U.S. Pat. No. 3,954,449 issued to Davidson in 1974.

After the single color electrostatic latent image is developed, drum 10 rotates to transfer station D. At transfer station D, the toner powder image adhering electrostatically to photoconductive surface 12 is transferred to a sheet of support material 48. Support material 48 may be plain paper or a sheet of plastic material, amongst others. Transfer station D includes a corona generating device, indicated generally by the reference numeral 50, and a transfer roll designated generally by the reference numeral 52. Corona generator 50 is excited with an alternating current and arranged to precondition the toner powder image adhering electrostatically to photoconductive surface 12. In this manner, the pre-conditioned toner powder image will be more readily transferred from the electrostatic latent image recorded on photoconductive surface 12 to support material 48 secured releasably on transfer roll 52. Transfer roll 52 recirculates support material 48 and is electrically biased to a potential of sufficient magnitude and polarity to attract electrostatically the pre-conditioned toner particles from the latent image recorded on photoconductive surface 12 to support material 48. Drum 10 and transfer roll 52 rotate in synchronism with one another, thereby maintaining support material 48 in registration with the electrostatic latent image recorded on photoconductive surface 12. Transfer roll 52 rotates in the direction of arrow 54. This enables successive toner powder images to be transferred to support material 48, in superimposed registration with one another. U.S. Pat. No. 3,838,918 issued to Fisher in 1974 discloses such a transfer system.

Cleaning apparatus 56 comprises a rotating brush contacting transfer roll 52. The brush is positioned within a housing for removing toner particles from the surface of transfer roll 52. The housing and brush are spaced from transfer roll 52 and are adapted to be advanced toward it for the cleaning operation at the appropriate time during a reproduction cycle, i.e., after transfer of the last toner powder image to support material 48 and the advancement thereof to the next successive processing station.

Turning now to a brief description of the sheet feeding path, support material 48 is advanced from a stack 58 mounted on tray 60. Feed roll 62, in operative communication with retard roll 64, advances and separates the uppermost sheet from stack 58. The advancing sheet moves into chute 66 which directs it into the nip between register rolls 68. Register rolls 68 align and forward the sheet to gripper fingers 70 which secure support material 48 releasably on transfer roll 52. After the requisite number of toner powder images have been transferred to support material 48, gripper fingers 50 release support material 48 and space it from transfer roll 52. As transfer roll 52 continues to rotate in the direction of arrow 54, stripper bar 72 is interposed therebetween. In this manner, support material 48 passes over stripper bar 72 onto endless belt conveyor 72. Endless belt conveyor 74 advances support material 48 to fixing station E.

At fixing station E, a fuser, indicated generally by the reference numeral 76, generates sufficient heat to permanently affix the multi-layered powder image to support material 48. A suitable fusing device is described in U.S. Pat. No. 3,781,156 issued to Tsilibes et al. in 1973.

After the fusing process, support material 48 is advanced by endless belt conveyors 79 and 80 and to catch tray 82 wherein the machine operator may remove the finished color copy therefrom.

Although a preponderance of the toner particles are transferred to support material 48, invariably some residual toner particles adhere to photoconductive surface 12 after the transfer process. These residual toner particles are removed from photoconductive surface 12 at cleaning station F. Cleaning station F includes a cleaning corona generating device 86, for neutralizing the electrostatic charge remaining on the residual toner particles and photoconductive surface 12. The neutralized toner particles are then cleaned from photoconductive surface 12 by a rotatably mounted fibrous brush 84 in contact therewith. A suitable brush cleaning device is described in U.S. Pat. No. 3,590,412 issued to Gerbasi in 1971.

It is believed that the foregoing description is sufficient for purposes of the present application to depict the general operation of an electrophotographic printing machine incorporating the features of the present invention therein.

Figure 2:
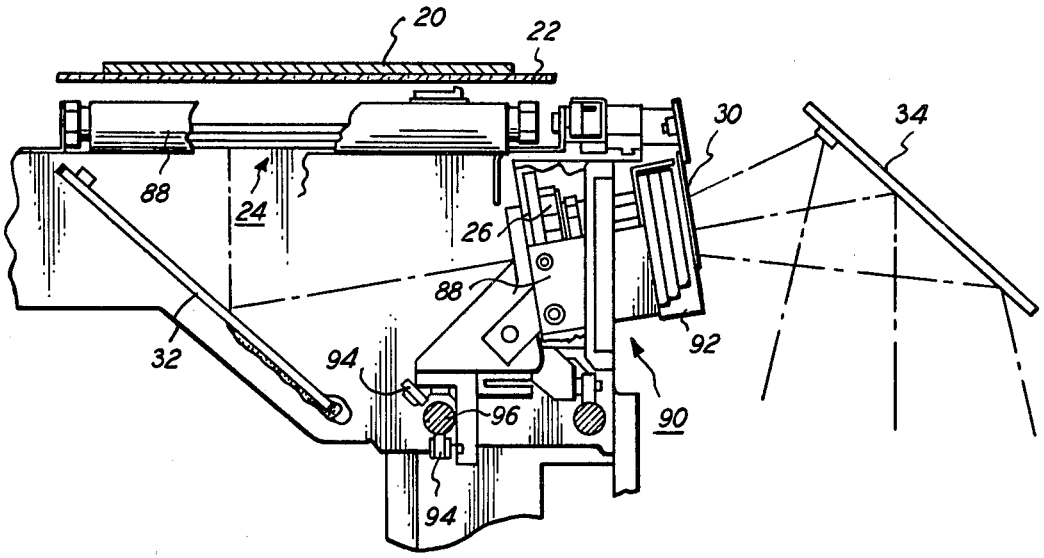
FIG. 2 is an elevational view of the optical system employed in the FIG. 1 printing machine.
Figure 3:
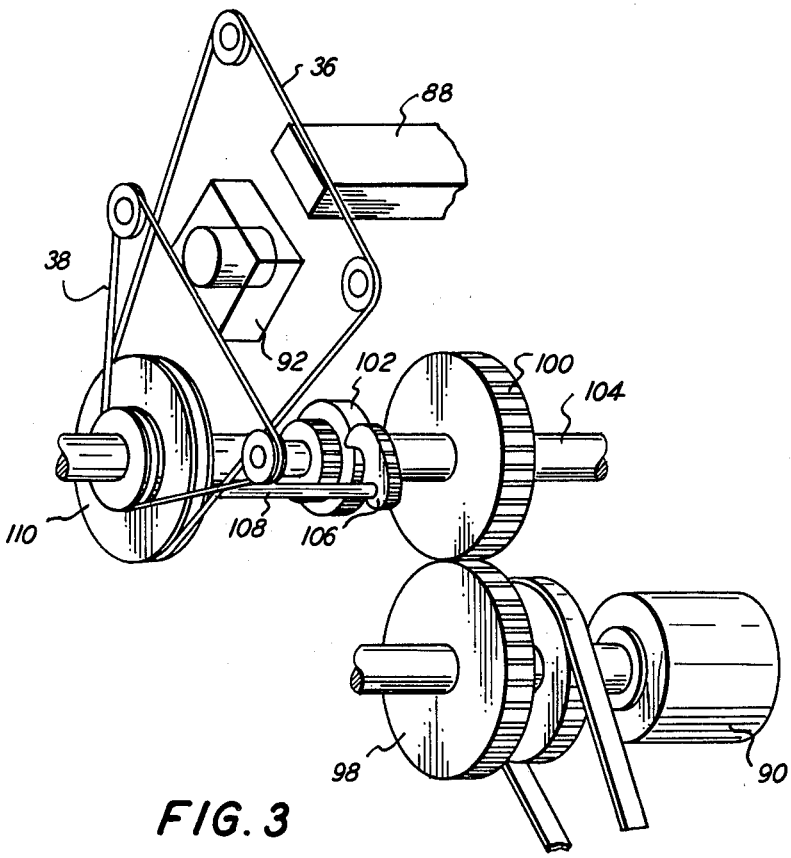
FIG. 3 is a schematic perspective view of the drive system employed to move the FIG. 2 optical system.

Referring now to FIGS. 2 and 3, the specific features of exposure station B will be described hereinafter. As previously indicated, lamp assembly 24, lens assembly 26 and filter assembly 30 are driven in a timed relationship with respect to the angular rotation of drum 10. These subassemblies are driven from an initial P to a final scan position and are rapidly retracted at termination of scan by a spring return mechanism. Lamp assembly 24 includes a carriage 88 which traverses the stationarily mounted platen 22 upon which document 20 is disposed. The lamp carriage supports a pair of tubular, elongated lamps. Carriage 88 is supported movably by the structure depicted in FIGS. 4 and 5 which will be discussed hereinafter in greater detail. Carriage 88 is driven by cable system 36 which is rotated by motor 90. The mechanical coupling between cable 36 and motor 90 is illustrated in FIG. 3. As carriage 88 traverses platen 22, another cable system 38 operates to simultaneously advance bracket 92 supporting lens 26 and filter 30. Bracket 92 is mounted on suitable rollers 94 surrounding a shaft 96 at a rate correlated with a speed of movement of carriage 88. Lens assembly 26 and optical filter assembly 30, as well as lamp carriage 88 scan document 20 to be reproduced in a direction which is perpendicular to the plane of the paper, as illustrated in FIG. 2. Upon reaching the final scan position, carriage 88, lens assembly 26, and filter 30 are returned to the initial position by a spring mechanism (not shown) so as to scan platen 22 during a subsequent imaging cycle.

Synchronized movement of carriage 88 and bracket 92 as well as drum 10 is achieved via the cable pulley system shown in FIG. 3. As shown thereat, motor 90 drives gear 98 which in turn, is meshed with gear 100. Movement of bracket 92 and carriage 88 is achieved through a sprocket 102 which is pinned to shaft 104 and engages a pawl 106. Sprocket 102 is electrically engaged to rotate with shaft 104 and engage pawl 106 at the initiation of scan and to release pawl 106 at the termination of scan. Pawl 106 is coupled through shaft 108 to pulley 110 which is rotatably mounted on shaft 104. Rotation of pawl 106 drives bracket 92 and carriage housing 88 through pulley 110 and cables 36 and 38. Pulley 110 is driven against the resistance of a return spring (not shown) which causes return of carriage 88 and bracket 90 upon release of pawl 106 at the termination of scanning.

Preferably, lens 26 is a six-element split dagor type of lens having front and compound back lens components with a centrally located diaphragm therebetween. Lens 26 forms a high quality image with a field angle of about 31° and a speed ranging from about F/4.5 to about F/8.5 at a 1:1 magnification. Moreover, lens 26 is designed to minimize the effect of secondary color in the image plane. The front lens component has three lens elements including, in the following order, a first lens element of positive power, a second lens element of negative power cemented to the first lens element, and a third lens element of positive power disposed between the second lens element and the diaphragm. The back lens component also has three similar lens elements positioned so that lens 26 is symmetrical. Specifically, the first lens element of the front component is a double convex lens, the second lens element a double concave lens, and the third element a convex-concave lens element. For greater details regarding lens 26, reference is made to U.S. Pat. No. 3,592,531 issued to McCrobie in 1971.

Filter 30 includes preferably a housing which is mounted on bracket 92 which also supports lens 26 during scanning as a single unit. The housing of filter 30 includes a window which is positioned relative to lens 26 permitting the light rays of the original document to pass therethrough. Bottom and top walls of the housing have a plurality of tracks extending the entire width thereof. Each of these tracks is adapted to carry a filter permitting the movement thereof from an inoperative position to an operative position. In the operative position, the filter is located in the window of the housing permitting light rays to pass therethrough. By way of example, three filters are employed in the electrophotographic printing machine, a red filter, a blue filter, and a green filter. A detailed description of the filter mechanism is found in U.S. Pat. No. 3,775,006 issued to Hartman et al. in 1973.

Preferably, lamps 26 are elongated tubular members having the temperature thereof thermostatically controlled. Sleeve heaters are provided for maintaining the lamps at a pre-determined temperature. The lamp and temperature control system is described in greater detail in U.S. Pat. No. 3,770,640 issued to Kidd in 1973.

Figure 4:
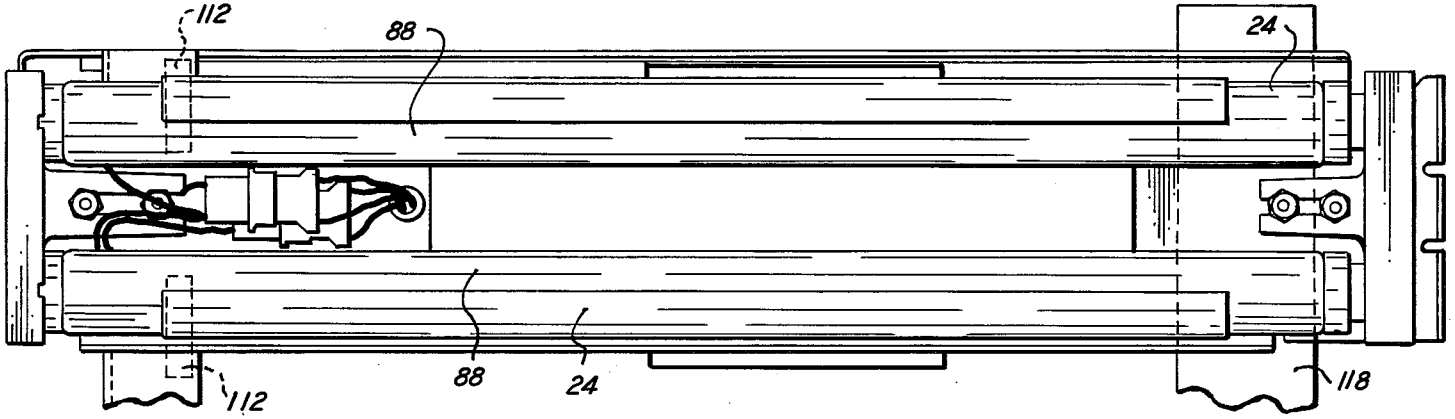
FIG. 4 is a plan view depicting the lamp carriage of the FIG. 2 optical system.
Figure 5:
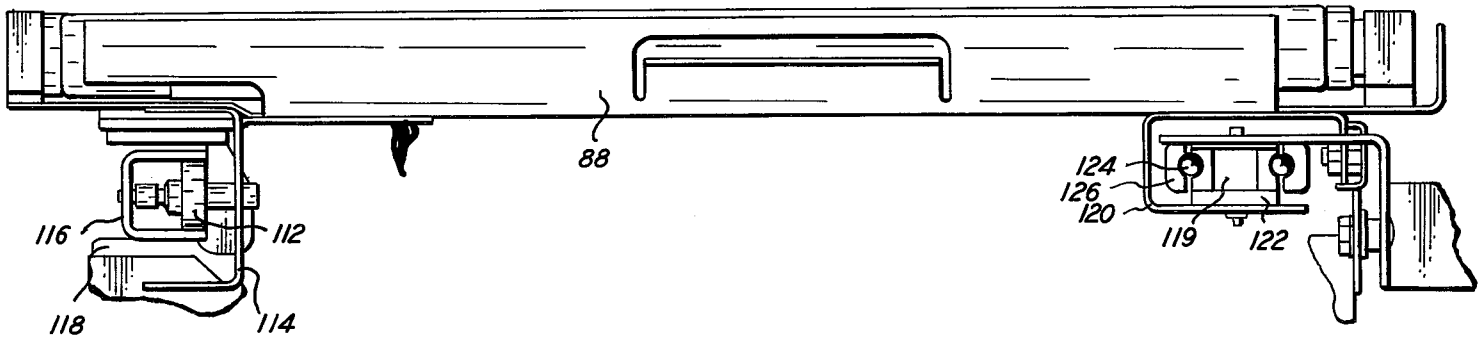
FIG. 5 is an elevational view showing the FIG. 4 lamp carriage.

Turning now to FIGS. 4 and 5, the detailed structure for preventing jitter and vibration of carriage 88 as it moves across platen 22 is described herein. A pair of rollers 112 are journalled for rotation on one side of carriage 88. Rollers 112 are mounted rotatably on a downwardly depending bracket 114 secured to carriage 88. A substantially U-shaped channel 116 is secured to frame 118 of the printing machine. Channel 116 extends the length of scan. Roller 112 is mounted interiorly of U-shaped bracket 116. Carriage 88 is supported on the other side of a ball slide, indicated generally by the reference numeral 119. A suitable anti-slip type of ball slide is made by the Microride Company of California. Bracket 120 is secured to lamp carriage 88 with inner slide member 122 being attached thereto. Inner member 122 is about four inches long and travels the entire length of scan with bracket 120. Ball bearings 124 extend about one half the length of outer slide member 126. Outer slide member 126 extends the length of scan. Ball bearings 124 move about one half the length of scan. In this manner, the movement of carriage 88 is restricted and jitter prevented. Hence, vibration of the scan lamp is substantially reduced and copy quality improve.

In recapitulation, it is evident that the scanning system of the electrophotographic printing machine depicted in FIG. 1 is arranged to minimize jitter as the lamps traverse the original document disposed on the platen. This is achieved by a pair of rollers mounted on one side of the lamp carriage and a ball slide positioned on the other side thereof. This combination stabilizes the lamp carriage to significantly reduce jitter during the scanning operation.

Hence, it is apparent that there has been provided in accordance with the present invention a scanning system for an electrophotographic printing machine that fully satisfies the objects, aims and advantages hereinbefore set forth. While this invention has been disclosed in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An apparatus for illuminating an article, including:
a light source;
means for supporting the article in a light receiving relationship with light rays transmitted from said light source;
a carriage having said light source mounted thereon;
a drive system for moving said carriage;
a frame;
a first U-shaped member mounted on said frame;
a pair of spaced rollers mounted rotatable on one end of said carriage and disposed in said first U-shaped member;
an inner slide member secured to the other side of said carriage;
an outer slide member secured to said frame; and
a plurality of ball bearings interposed between said inner slide member and said outer slide member providing a rolling support for said carriage.

2. An apparatus as recited in claim 1, wherein said drive system includes:
a motor; and
a cable system coupling said motor with said carriage so that rotation of said motor translates said carriage across said supporting means illuminating successive portions of the article disposed thereon.

3. An apparatus as recited in claim 2, wherein said light source is a substantially elongated tubular member.

4. An electrophotographic printing machine of the type having an apparatus for illuminating an original document being reproduced thereby, wherein the improvement includes:
a light source;
means for supporting the original document in a light receiving relationship with light rays transmitted from said light source;
a carriage having said light source mounted thereon;
a drive system for moving said carriage;
a frame;
a first U-shaped member mounted on said frame;
a pair of spaced rollers mounted rotatably on one of said carriage and disposed in said first U-shaped member;
an inner slide member secured to the other side of said carriage;
an outer slide secured to said frame; and
a plurality of ball bearings interposed between said inner slide member and said outer slide member providing a rolling support for said carriage.

5. A printing machine as recited in claim 4, wherein said drive system includes:
a motor;
a cable system coupling said motor with said carriage so that rotation of said motor translates said carriage across said supporting means illuminating successive portions of the original document disposed thereon.

6. A printing machine as recited in claim 5, wherein said light source is a substantially elongated tubular member.

* * * * *